US005765615A

United States Patent [19]

Chapman et al.

[11] Patent Number: 5,765,615

[45] Date of Patent: Jun. 16, 1998

[54] CANTER WITH CURVE-CUTTING CAPABILITY

[75] Inventors: John R. Chapman; Ernie R. Buchacher, both of Langley, Canada

[73] Assignee: Optimil Machinery, Inc., British Columbia, Canada

[21] Appl. No.: 717,546

[22] Filed: Sep. 20, 1996

[51] Int. Cl.[6] ..... B27B 1/00; B27C 9/00

[52] U.S. Cl. ..... 144/39; 144/3.1; 144/357; 144/369

[58] Field of Search ..... 144/1.1, 3.1, 39, 144/41, 176, 356, 357, 367, 369

[56] References Cited

U.S. PATENT DOCUMENTS

| | | | |
|---|---|---|---|
| 4,077,448 | 3/1978 | Hasenwinkle et al. | 144/357 |
| 4,440,203 | 4/1984 | Östberg . | |
| 4,449,557 | 5/1984 | Mäkelä et al. | 144/357 |
| 4,467,684 | 8/1984 | Thorsell . | |
| 4,485,861 | 12/1984 | Nilsson et al. | 144/357 |
| 4,548,247 | 10/1985 | Eklund . | |
| 4,572,256 | 2/1986 | Rautio . | |
| 4,637,443 | 1/1987 | Jansson . | |
| 4,750,535 | 6/1988 | Wolf . | |
| 4,793,390 | 12/1988 | Stroud . | |
| 4,947,909 | 8/1990 | Stroud . | |
| 5,143,127 | 9/1992 | Rautio . | |
| 5,243,888 | 9/1993 | Bowlin . | |
| 5,400,842 | 3/1995 | Brisson | 144/357 |
| 5,447,187 | 9/1995 | Achand et al. | 144/357 |

*Primary Examiner*—W. Donald Bray
*Attorney, Agent, or Firm*—Kolisch, Hartwell, Dickinson, McCormack & Heuser

[57] ABSTRACT

A canter capable of curve-cutting featuring rotary, power-driven frustro-conical chipper heads for chipping a workpiece, which chipper heads are adjustable under the influence of movement structure to achieve five degrees of freedom of motion and adjustment which take into account the different topographical characteristics of different workpieces.

28 Claims, 3 Drawing Sheets

CANTER WITH CURVE-CUTTING CAPABILITY

BACKGROUND AND SUMMARY OF THE INVENTION

This invention relates to a canter, and in particular to a canter for making a four-sided cant from a two-sided cant (the workpiece). Specifically, it relates to such a machine which is capable of both straight- and curve-cutting, and wherein cant-cutting is performed by a pair of rotary, power-driven, frustro-conical chipper heads. The heads in this machine are specially mounted for many degrees of angular and translational movement and repositioning in order to deal effectively with specific cutting requirements for different workpieces (straight and curved).

In relation to such a machine, those skilled in the art will recognize the importance which the juxtaposition of a workpiece and the chipper heads have in relation to the acceptability of the finally cut product. This is an especially important consideration during a curve-cutting operation. It is typical, for example, that the usual, two, frustro-conical chipper heads which face one another in the machine are adjusted to have what is known as "lead", or a "lead angle", in relation to the direction in which a workpiece is fed between these heads. More particualry, it is typical that the upstream sides of the heads are slightly closer together than the downstream sides so that the "cutting planes" of the heads diverge at a very slight acute angle progressing past them in a downstream direction in the machine. Lead produces a cut product which appears to have been sawn, thus to present a smooth finish without nicks, ridges or other knife marks. The presence of lead angle also results in the cut surfaces of a workpiece having slight concavity, and the greater the lead angle, the more pronounced and detectable is this concavity. While experience over the years has shown that a certain slight amount of concavity is acceptable, it is preferable that such concavity both be maintained at a minimum, and be substantially "centered" vertically between the upper and lower edges of the two opposing lateral faces which are normally formed during a cutting operation.

In a curve-cutting situation, more than "normal" lead is required for the chipper heads in order to assure that the downstream, trailing sides of the heads do not score or recut a curved workpiece. Under such a circumstance, paying close attention to minimize an undesirable finished characteristic, referred to as "off-flatness", is important. Off-flatness is accentuated where, both, more than usual concavity ends up the finished cut surfaces, and this concavity is not substantially vertically centered.

Thus, problems can arise in situations where a machine is expected to handle incoming workpieces which have varying, and particularly widely varying, vertical dimensions if the machine is not equipped to allow and promote easy and effective vertical repositioning of the chipper heads so as to "center" cutting concavity appropriately for each workpiece.

Prior machines have not addressed this off-flatness issue, and accordingly, one of the important objects of the present invention is to offer, among other things, practical and versatile vertical adjustability of opposed chipper heads to deal with this issue. In particular, the machine of the invention provides for such adjustability in a fashion which makes vertical adjustment something that is completely independent of other kinds of adjustments, and thus "tunable" accurately for different workpieces without affecting other cutting/adjustment parameters, such as chipper-head spacing, skewing, lateral positioning, lead, etc.

Still a further object of the invention is to provide a curve-cutting-capable canter wherein not just one, but many (five in the preferred embodiment which is described herein) independent degrees of freedom of positional adjustability are provided for the chipper heads.

Thus, and in the preferred embodiment of this invention, power-driven, frustro-conical chipper heads are mounted in such a manner that they can be adjusted independently to change lead angle, to change separation, to shift as a unit laterally to accommodate appropriate curvature-following curve-cutting, to rotate as a unit about a vertical axis so as to change the orientations (skew) vertically of the cutting planes of the chipper heads—thus to position the heads angularly most appropriately for the nature of workpiece curvature, as well as to shift vertically on a rocker assembly to accommodate appropriate vertical positioning (facial flatness consideration) for each workpiece.

The capability to adjust lead allows one to set the most appropriate lead for the character of each workpiece, straight or curved, which produces the best possible flatness for the cut surfaces, and allows for the best possible guiding for travel of a workpiece.

These and other features and advantages that are offered by the invention, will become more fully apparent as the description which now follows is read in conjunction with the accompanying drawings.

DETAILED DESCRIPTION OF THE INVENTION

Figure 1:
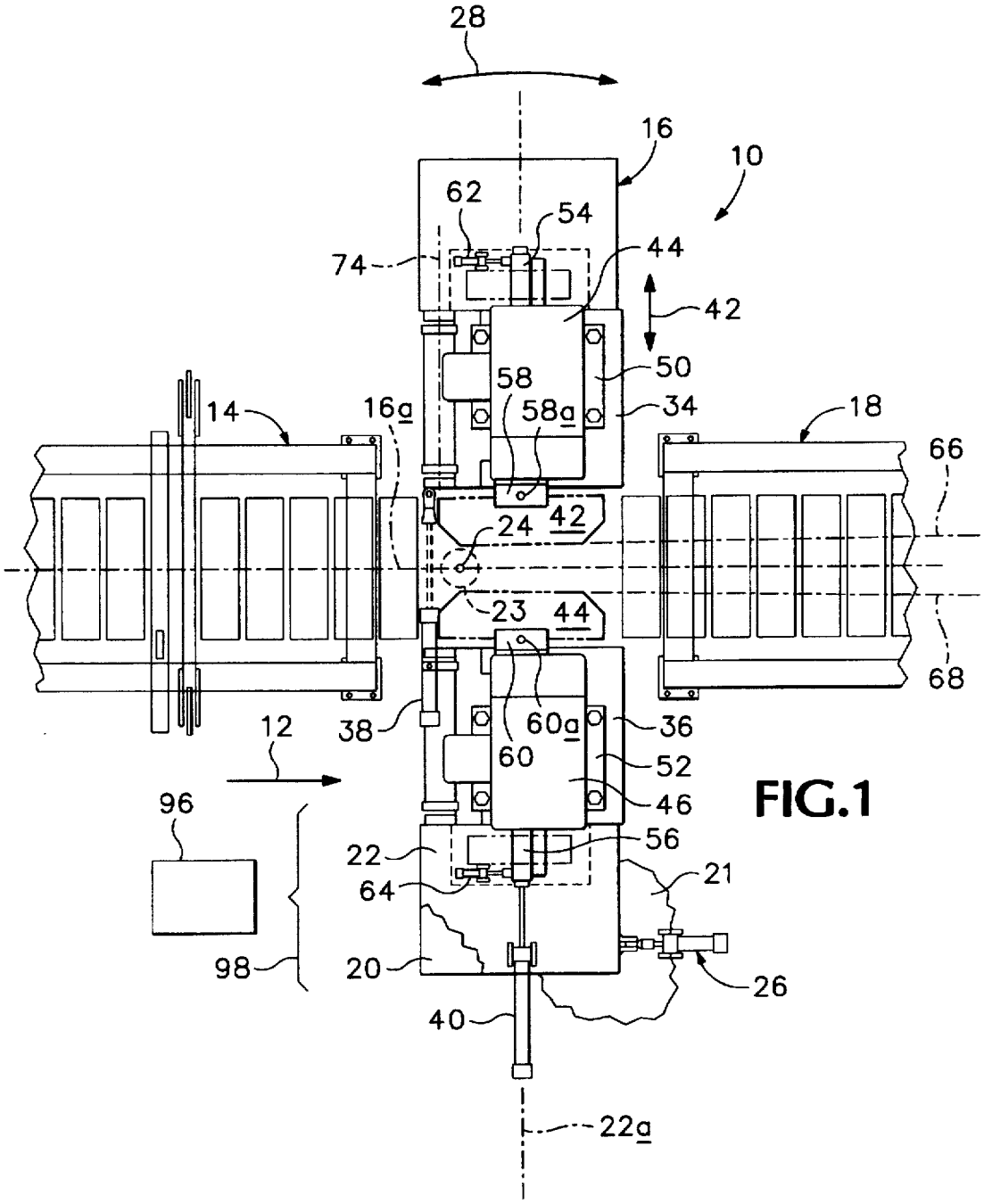
FIG. 1 is a fragmentary, schematic plan view illustrating a curve-cutting-capable canter machine employing a pair of proposed, power-driven, frustro-conical chipper heads which are mounted for relative positioning and adjustment in accordance with the features of the present invention.

Turning attention now to all of the drawing figures, indicated generally at 10 (see particularly FIGS. 1 and 2) is a canter which is capable of performing both straight- and curve-cutting operations, and which, as illustrated, is constructed in accordance with the features of the present invention to prepare a four-sided cant from a previously prepared two-sided cant. A two-sided cant is typically prepared, either by sawing or chipping operations, to have two, opposed, parallel faces, on one of which it will lie and be supported for transport through canter 10 generally in the direction of arrow 12.

Canter 10 includes three mechanical assemblages, including an infeed conveyor mechanism, or conveyor, 14, a chipper mechanism 16, and an outfeed or discharge conveyor mechanism, or conveyor, 18. The infeed and discharge conveyors are entirely conventional in construction, form no part of the contributions made by the present invention to the state of the canter art, and thus are not discussed herein in any detail. Suffice it to say that a two-sided cant which is to be processed by the machinery of the present invention, which cant is also referred to herein as a workpiece, is power-driven from infeed conveyor 14 into chipper mechanism 16, and power-driven away from the chipper mechanism by discharge conveyor 18.

From the description which follows, those skilled in the art will recognize how different sizes of workpieces in a particular setting can be accommodated by appropriately sizing all of the constituents of a canter, such as canter 10. Put another way, machinery constructed in accordance with the present invention can be sized appropriately for different specific operations. With respect to canter 10 as described and illustrated herein, this machine has been designed to handle a workpiece which might typically have a length within the range of about 16- to about 24-feet, and which might have a vertical dimension (that dimension which is normal to the plane of FIG. 1) where it enters the chipper mechanism of up to about 20-inches.

As will become apparent, and as has already been mentioned, canter 10 is designed to operate both in a very conventional manner to work upon straight workpieces, as well as to operate in a non-conventional manner (according to the present invention) wherein it employs curve-cutting activity to work upon curved workpieces. The ways in which this important versatility is accommodated in canter 10 will become apparent shortly. Given the operational parameters which have been designed, as will be explained, in the specific structure now being described, canter 10 is able, for example, to handle curve-cutting of a curved workpiece which might have a curvature deviation of up to about 5-inches from end to end. The workpiece feed speed for canter 10 lies typically within the range of about 180- to about 450-feet-per-minute.

The special features which are offered by the present invention reside specifically within the confines of chipper mechanism, or chipper, 16. In relation to describing these features, it is not necessary to go into great detail about the precise form of assembly within the chipper, in as much as, given the description which now follows, those skilled in the art will readily be able to build and employ such structure. Put another way, different designers of different specific chippers which embody the features of the present invention can employ widely differing detailed approaches to assembly, all of which will yield a chipper having the features and versatility offered by the invention.

And so, describing now chipper 16, and beginning, so-to-speak, from the ground up, the chipper includes a main, stationary frame 20 which is suitably anchored in place on the floor or other support structure (shown fragmentarily at 21 in FIGS. 1 and 2) found within the facility where canter 10 is employed. Chipper 16 defines nominally a travel path shown by a dash-dot line at 16*a* for a workpiece, and the infeed and discharge conveyors are appropriately aligned with the chipper to provide infeed and discharge travel paths that are generally coincident nominally with path 16*a*.

One of the interesting and distinguishing features of the invention which will come to be understood when this specification is read in conjunction with the drawings is that each workpiece, regardless of its condition of curvature or non-curvature, travels through the chipper along path 16*a* which, except for occasional skewing pursuant to an adjustment made possible by the invention, is an unvarying path. Adjustments to accommodate curvature are made, not by repositioning a workpiece to travel along a varying travel path, but rather by making adjustments, as will soon be described, within the chipper configuration itself to accommodate such curvature.

Figure 3:
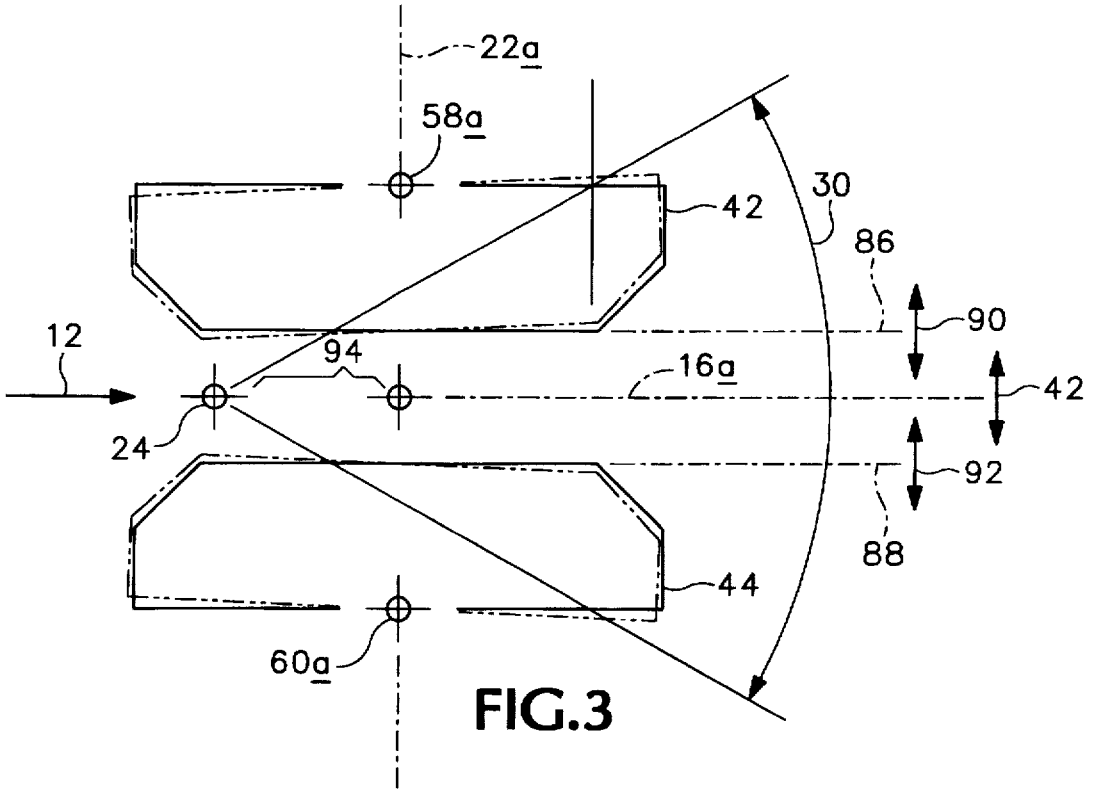
FIG. 3 is a fragmentary, limited-content, plan view taken generally from the point of view employed in FIG. 1, on a larger scale than FIGS. 1 and 2, and illustrating (with moved conditions shown and suggested) four of the degrees of freedom of relative motion and adjustability afforded the chipper heads in the canter of FIG. 1.

Supported on and above frame 20 is an elongate skewing subframe 22 whose long axis is indicated (see particularly FIGS. 1 and 3) by dash-dot line 22*a*. In particular, subframe 22 is joined, generally centrally between its opposite ends, to frame 20 through a journal connection 23, which is shown in dashed lines in FIG. 1, which connection allows for a slight amount of selective clockwise and anti-clockwise rotation or skewing (as seen in FIGS. 1 and 3), about a journal axis 24 which is normal to the planes of FIGS. 1 and 3. Opposite ends of subframe 22, on their undersides, ride on the mainframe through appropriate roller supports (not shown). Skewing motion is introduced into subframe 22 by means of an electrical linear positioner 26 (seen only in FIG. 1) which effectively acts between frame 20 and subframe 22. Back and forth skewing activity is indicated in FIGS. 1 and 3 by means of double-ended curved arrows 28, 30, respectively. From its nominal central (non-skewed) condition which is illustrated in FIG. 1, skewing of the subframe can occur within a range which has been chosen for canter 10 to lie within the range of about plus or minus 10-degrees. Arrows 28, 30 exaggerate this range in the drawings simply for illustration purposes. While such a range is clearly a matter of choice, the range expressed herein has been chosen to accommodate skewing activity appropriate to deal with curved workpieces having a curvature deviation up to the amount of deviation expressed earlier herein.

Figure 2:
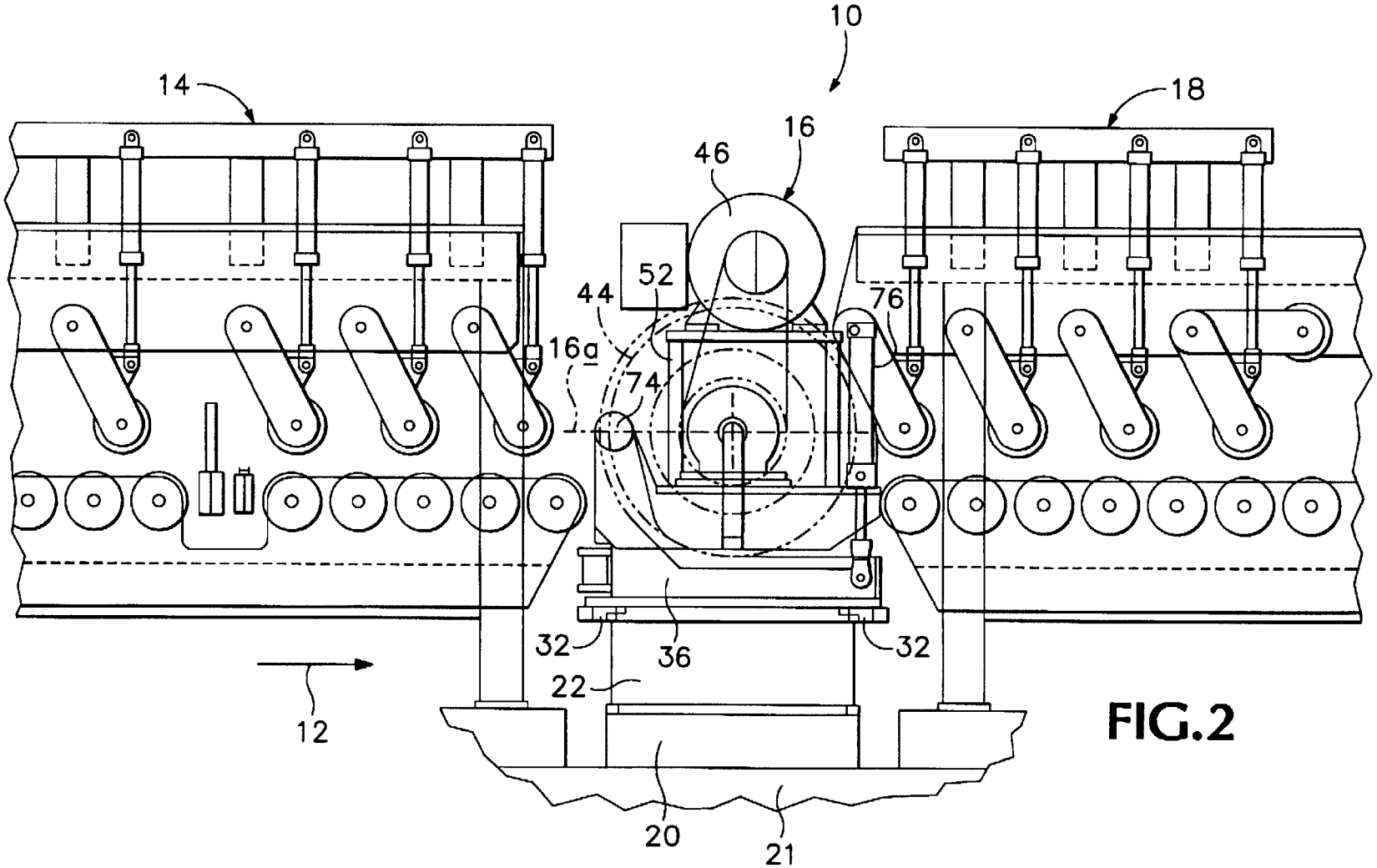
FIG. 2 is a fragmentary side elevation of the canter of FIG. 1, taken generally from the bottom side of FIG. 1 and drawn on a somewhat larger scale.

Slideably mounted on subframe 22 through rail structure which is indicated at 32 in FIG. 2 are two sliding subframes 34, 36. Rail structure 32 accommodates reversible sliding of these two subframes back and forth generally in the direction of previously mentioned skewing subframe axis 22*a*. Drivingly interposed and interconnecting subframes 34, 36 is a hydraulic ram 38 (seen only in FIG. 1) which can be extended and contracted, and then locked, to change the lateral spacing between subframes 34, 36. When ram 38 is locked, it defines a fixed spacing between the sliding subframes, and results in a situation in which any sliding activity is characterized by the two subframes moving back and forth as a single unit. Illustrated at 40, and again only in FIG. 1, is a hydraulic ram which is operatively interposed skewing subframe 22 and sliding subframe 36. Operation of ram 40, under circumstances with ram 38 locked, functions, through extension and contraction of ram 40 to shift the two sliding subframes back and forth as a single unit along the skewing subframe. In FIGS. 1 and 3, such back and forth sliding-as-a-unit motion is suggested by double-ended arrow 42.

Included in chipper 16 are two conventional, power-driven, rotary, frustro-conical chipper heads 42, 44 which, along with their respective drive motors 44, 46 are mounted on sliding subframes 34, 36, respectively, through rocking subframes 50, 52, respectively. Chipper heads 42, 44, whcih may be made in accordance with the teachings of U.S. Pat. No. 4,690,186 issued September, 1987 for LOG FEED APARATUS, are carried on arbor structures 54, 56, respectively (see particularly FIG. 1), which arbor structures are supported in bearing blocks 58, 60, respectively, that include inner and outer races (not shown) which have sufficient "play" within them to allow a limited amount of pivoting to occur about axes 58*a*, 60*a* respectively, which extend through the bearing blocks in directions substantially normal to the plane of FIG. 1. It is these pivot axes which accommodate adjustment of the lead provided for the chipper heads, and pivoting to change lead is performed by extension and contraction of hydraulic rams 62, 64 (see FIG. 1) which are drivingly interposed arbor structures 54, 56, respectively, and rocking subframes 50, 52, respectively.

In the conditions of the chipper heads as they are shown in FIG. 1, the cutting planes of heads 42, 44, pictured by dash-dot lines 66, 68, respectively, in FIG. 1, diverge progressing in a downstream direction through and past the heads to provide a typical, normal amount of lead associated with the cutting of straight workpieces. This lead results in the downstream edges of the knives in the chipper heads being about 0.04-inches further apart than the edges of the knives on the upstream sides of the heads. Operation of rams 62, 64 in canter 10 can change this lead to create a spacing difference up to about 0.5-inches, and this is the kind of adjustment which is done according to the invention to deal with different conditions of workpiece curvature.

Figure 4:
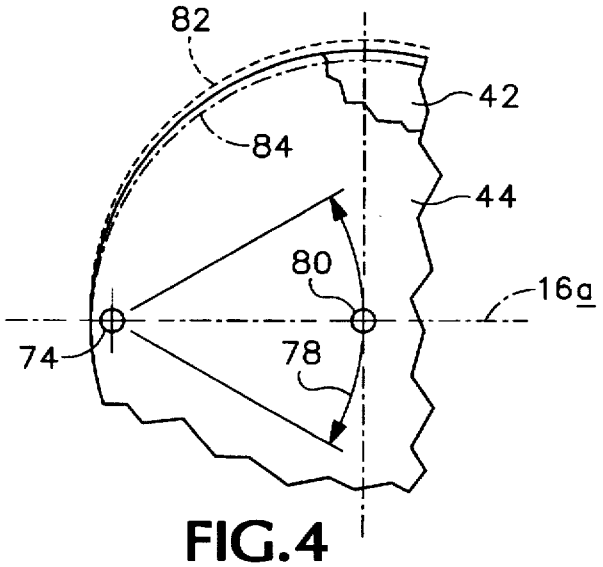
FIG. 4 is a fragmentary, linited-content elevation taken from the bottom side of FIG. 3, illustrating the fifth degree of freedom and motion afforded the chipper heads, and in particular, shows the rocking, vertical-positioning capability offered for the chipper heads in the canter of FIG. 1.

Rocking subframes 50, 52 are mounted on sliding subframes 34, 36, respectively, through journal connections 70, 72, respectively, which permit rocking of the rocking subframes about a common axis 74 which generally parallels previously mentioned long axis 22*a*. Rocking of the rocking subframes is performed by hydraulic rams, only one of which is shown at 76 in FIG. 2, which rams are drivingly interposed the rocking subframes and their respective associated sliding subframes. Rocking capability is illustrated by double-ended curved arrow 78 seen in FIG. 4. In chipper 16, the range of rocking afforded allows raising and lowering the centers of rotation of the chipper heads approximately plus or minus about 3-inches relative to a nominal position shown at 80 in FIG. 4. One upwardly rocked condition for the chipper heads is shown in FIG. 4 by dashed line 82, and one downwardly rocked position is illustrated by dash-dot line 84 in this same figure.

Collectively, positioner 26 and rams 38, 40, 62, 76 are referred to as movement structure, with each of these devices individually also referred to as a mechanism. In addition, ram 76 is referred to as a rocking structure.

Focusing attention on certain additional things which are pictured in FIG. 3, the two chipper heads are shown in solid lines with a zero-lead condition, and in dash-dot lines in a somewhat increased lead condition. A nominal separation between the heads is pictured by dash-dot lines 86, 88, and double-ended arrows 90, 92 indicate how this spacing can be changed reversibly under the influence of previously mentioned ram 38.

Finally, while journal axis 24 has been selected to lie opposite, essentially, the upstream edges of the knives in the chipper heads, different applications might dictate shifting the position of this journal axis to different locations within the range generally embraced by bracket 94 in FIG. 3 which extends inwardly to a point which is generally coincident with the rotational axes of the chipper heads.

Completing now a description of what is shown in the drawings, pictured in FIG. 1 by a block 96 is computer structure which is also referred to herein as workpiece information structure. Through suitable conventional methodology, storable within a portion of block 96 on the basis of (typically) scanning data relating to successive workpieces, is control information that ties in, in a detailed way, to the three-dimensional configuration of each workpiece. This information is employed by a computer which is resident within block 96, on the fly, and thus during a live cutting operation, to control the activities involved with the five degrees of freedom and adjustability which have been described for chipper 16. Suitable operative control connections are established between block 96 and the various rams and the linear positioner described hereinabove, and these control connections are represented in FIG. 1 by bracket 98.

In a straight-cutting operation, through operation of ram 38, the chipper heads are spaced apart by the amount appropriate to produce the desired spacing between the opposite workpiece faces which will be cut. Through operation of ram 40, and with locking of ram 38, the chipper heads are positioned laterally so as to center them, so-to-speak, on opposite sides of path 16*a*. Through operations of the rams like ram 76, the heads are positioned vertically so as to produce vertically centered concavity with respect to the finally cut faces. Lead is adjusted to a normal straight-cutting lead situation, and feeding and cutting of a workpiece then proceeds. These are the only kinds of adjustments which are required during straight-cutting.

During curve-cutting, the computer in block 96, in addition to adjusting lateral spacing between the chipper heads, and centralizing of them relative to path 16*a*, determines and controls how, as a curved workpiece makes its way through the chipper, the heads should reside vertically, something which typically will not be (though could be) changed during a cutting operation. The computer also determines how and when lead between the chipper heads ought to be varied, as well as how and when lateral repositioning of the entire assembly, and/or skewing thereof ought to occur in order to accommodate proper curvature-following for a workpiece.

The versatility of this machinery ought now to be very apparent to those skilled in the art. The machinery of the invention handily accommodates both straight-cutting and curve-cutting under a wide variety of circumstances, allows a workpiece essentially to follow an unchanging travel path through the machinery, assures vertical positioning of chipper heads at the most appropriate location to avoid the off-flatness condition described earlier, and, on the fly, adjusts lateral positioning and skewing, and if need be lead, in order to deal with the precise curvature information that characterizes each workpiece, as such information is translated into control signals from block 96.

Thus, while a preferred embodiment of the invention has been described herein, with recognition given to the fact that adjustment ranges and the sizes of things can be varied to suit different circumstances, it is appreciated that other variations and modifications may be made without departing from the spirit of the invention.

What is claimed is:

1. A canter capable of curve-cutting comprising a frame, a rotary, power-driven, frusto-conical chipper head for chipping a workpiece, and movement structure mounting said head on said fiame for workpiece associated selective repositioning relative to said frame, wherein said movement structure includes mechanism enabling changing of the vertical position of said head relative to said frame.

2. The canter of claim 1, wherein said movement structure includes mechanism enabling changing of the lead for said head.

3. The canter of claim 1, wherein said movement structure includes mechanism enabling changing of the lateral position of said head relative to said frame.

4. The canter of claim 1, wherein said canter defines a travel path for a workpiece, said head defines a cutting plane which is offset relative to said travel path in the vicinity of said head, and said movement structure includes mechanism which enables changing of the spacing between said path and said plane.

5. The canter of claim 1, wherein said canter defines a travel path for a workpiece, said head defines a cutting plane which is offset relative to said travel path in the vicinity of said head, and said movement structure includes mechanism enabling changing of the angular orientation of said path without changing the positional relationship between said path and said plane.

6. The canter of claim 1 which further includes workpiece information structure operatively connected to said movement structure and containing control information relating to the configuration of each workpiece, said information structure being operable during a cutting operation to effect selected operation(s) of said movement structure.

7. The canter of claim 2 which further includes workpiece information structure operatively connected to said movement structure and containing control information relating to the configuration of each workpiece, said information structure being operable during a cutting operation to effect selected operation(s) of said movement structure.

8. The canter of claim 3 which further includes workpiece information structure operatively connected to said movement structure and containing control information relating to the configuration of each workpiece, said information being operable during a cutting operation to effect selected operation(s) of said movement structure.

9. The canter of claim 4 which further includes workpiece information structure operatively connected to said movement structure and containing control information relating to the configuration of each workpiece, said information structure being operable during a cutting operation to effect selected operation(s) of said movement structure.

10. The canter of claim 5 which further includes workpiece information structure operatively connected to said movement structure and containing control information relating to the configuration of each workpiece, said information structure being operable during a cutting operation to effect selected operation(s) of said movement structure.

11. A canter capable of curve-cutting comprising a frame, a pair of rotary, power-driven, frustro-conical chipper heads for chipping a workpiece, and movement structure mounting said heads on said frame for workpiece associated selective repositioning relative to said frame, wherein said movement structure includes mechanism enabling changing of the vertical positions of said heads relative to said frame.

12. The canter of claim 11, wherein said movement structure includes mechanism enabling changing of the lead for said heads.

13. The canter of claim 11, wherein said movement structure includes mechanism enabling changing of the lateral positions of said heads relative to said frame.

14. The canter of claim 11, wherein said canter defines a travel path for a workpiece, said heads each defines a cutting plane which is offset relative to said travel path in the vicinity of the head, and said movement structure includes mechanism which enables changing of the spacing between said path and said planes.

15. The canter of claim 11, wherein said canter defines a travel path for a workpiece, said heads each defines a cutting plane which is offset relative to said travel path in the vicinity of the head, and said movement structure includes mechanism enabling changing of the angular orientation of said path without changing the positional relationship between said path and said plane.

16. The canter of claim 11 which further includes workpiece information structure operatively connected to said movement structure and containing control information relating to the configuration of each workpiece, said information being operable during a cutting operation to effect selected operation(s) of said movement structure.

17. The canter of claim 12 which further includes workpiece information structure operatively connected to said movement structure and containing control information relating to the configuration of each workpiece, said information structure being operable during a cutting operation to effect selected operation(s) of said movement structure.

18. The canter of claim 13 which further includes workpiece information structure operatively connected to said movement structure and containing control information relating to the configuration of each workpiece, said information structure being operable during a cutting operation to effect selected operation(s) of said movement structure.

19. The canter of claim 10 which further includes workpiece information structure operatively connected to said movement structure and containing control information relating to the configuration of each workpiece, said information structure being operable during a cutting operation to effect selected operation(s) of said movement structure.

20. The canter of claim 15 which further includes workpiece information structure operatively connected to said movement structure and containing control information relating to the configuration of each workpiece, said information structure being operable during a cutting operation to effect selected operation(s) of said movement structure.

21. In a curve cutting machine a rotary, power-driven chipper head for chipping a workpiece, and movement structure mounting said head for selective vertical, lateral and angular repositioning motion during operation of the head.

22. The organization of claim 21 wherein said movement structure offers five degrees of freedom of movement for said head.

23. The organization of claim 21 which further includes workpiece information structure which contains control information relating to the detailed configuration of a workpiece which is to be chipped as the same travels past said chipper head, said workpiece information structure being operatively connected to said movement structure and operable to cause the movement structure to effect as-necessary repositioning of the chipper head in accordance with such control information.

24. The organization of claims 21, 22, or 23, wherein said chipper head is of the frustro-conical type.

25. The organization of claims 21, 22, or 23, wherein vertical movement is effected through rocking structure to which said head is operatively connected.

26. The organization of claim 24, wherein vertical movement is effected through rocking structure to which said head is operatively connected.

27. The organization of claims 21, 22, or 23 which further includes a second power-driven chipper head that is spaced from and faces the first-mentioned head, and wherein lateral movement includes both lateral shifting of both heads as a unit (without relative lateral motion between the heads), and, independently, relative lateral shifting of the heads to change the spacing therebetween.

28. The organization of claim 24 which further includes a second power driven chipper head that is spaced from and faces the first-mentioned head, and wherein lateral movement includes both lateral shifting of both heads as a unit (without relative lateral motion between the heads), and, independently, relative lateral shifting of the heads to change the spacing therebetween.

* * * * *